US006571708B1

(12) United States Patent
Rudzewitz et al.

(10) Patent No.: US 6,571,708 B1
(45) Date of Patent: Jun. 3, 2003

(54) METHOD AND DEVICE FOR IN-REGISTER PRE-POSITIONING A PRINTING PLATE

(75) Inventors: Stephan Rudzewitz, Walldorf (DE); Frank Schumann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/243,835

(22) Filed: Feb. 1, 1999

(30) Foreign Application Priority Data

Jan. 30, 1998 (DE) ..... 198 03 723

(51) Int. Cl.[7] ..... B41L 47/14

(52) U.S. Cl. ..... 101/477; 101/DIG. 36; 101/479; 101/395; 101/485; 101/415.1

(58) Field of Search ..... 33/617, 621; 101/477, 101/479, 382.1, 383, 384, 395, 485, 486, DIG. 36, 415.1, 378

(56) References Cited

U.S. PATENT DOCUMENTS

| | | | | | |
|---|---|---|---|---|---|
| 3,882,775 | A | * | 5/1975 | Lytle et al. | 101/415.1 |
| 5,063,843 | A | | 11/1991 | Becker | |
| 5,094,165 | A | * | 3/1992 | Sugiyama et al. | 101/415.1 |
| 5,111,744 | A | * | 5/1992 | Wieland | 101/216 |
| 5,289,773 | A | * | 3/1994 | Saito et al. | 101/415.1 |
| 5,320,041 | A | * | 6/1994 | Maejima et al. | 101/415.1 |
| 5,331,893 | A | * | 7/1994 | Wieland | 101/486 |
| 5,370,051 | A | * | 12/1994 | Schild et al. | 101/415.1 |
| 5,383,402 | A | * | 1/1995 | Takano et al. | 101/415.1 |
| 5,394,614 | A | * | 3/1995 | Lindner et al. | 33/621 |
| 5,461,980 | A | | 10/1995 | Maejima et al. | |
| 5,479,859 | A | * | 1/1996 | Lindner et al. | 101/485 |
| 5,492,060 | A | | 2/1996 | Haaf et al. | |
| 5,537,926 | A | | 7/1996 | Beisel et al. | |
| 5,634,406 | A | * | 6/1997 | Lindner et al. | 101/486 |
| 5,715,751 | A | * | 2/1998 | Nobuta et al. | 101/415.1 |
| 5,937,149 | A | | 8/1999 | Lindner et al. | |

FOREIGN PATENT DOCUMENTS

| | | | | | |
|---|---|---|---|---|---|
| DE | 3050295 | C1 | | 11/1985 | |
| DE | 35 27 103 | A1 | | 10/1986 | |
| DE | 3638428 | | * | 6/1988 | 101/DIG. 36 |
| DE | 3710257 | C2 | | 5/1989 | |
| DE | 4126643 | A1 | | 2/1993 | |
| DE | 41 30 359 | C2 | | 3/1993 | |
| DE | 42 26 780 | C2 | | 2/1994 | |
| DE | 43 06 677 | A1 | | 9/1994 | |
| DE | 43 27 013 | C1 | | 1/1995 | |
| DE | 43 32 803 | C2 | | 3/1995 | |
| DE | 195 08 844 | A1 | | 9/1996 | |
| DE | 195 39 453 | A1 | | 4/1997 | |
| DE | 196 11 530 | C1 | | 10/1997 | |
| DE | 196 36 703 | A1 | | 3/1998 | |
| EP | 75900 | | * | 4/1983 | 101/DIG. 36 |
| EP | 0 653 301 | A1 | | 5/1995 | |
| EP | 0 808 714 | A2 | | 11/1997 | |
| GB | 2 275 655 | B | | 9/1994 | |
| GB | 2 311 254 | A | | 9/1997 | |
| JP | 62-221541 | A | * | 9/1987 | B41F/27/12 |

OTHER PUBLICATIONS

German Utility Model DE 296 15 902 U1, dated Feb. 19, 1997, device for tightening a printing plate on a cylinder.

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A method for in-register pre-positioning a printing plate in a plate feeding device, wherein the printing plate is pre-positioned by a positioning device of the plate feeding device, and then fed to a plate cylinder and clamped into a leading edge clamping device of the plate cylinder, includes detecting the in-register pre-positioning by sensors and, if appropriate, correcting the pre-positioning, and then transferring the printing plate in-register to the leading edge clamping device of the plate cylinder; and a device for performing the method.

10 Claims, 4 Drawing Sheets

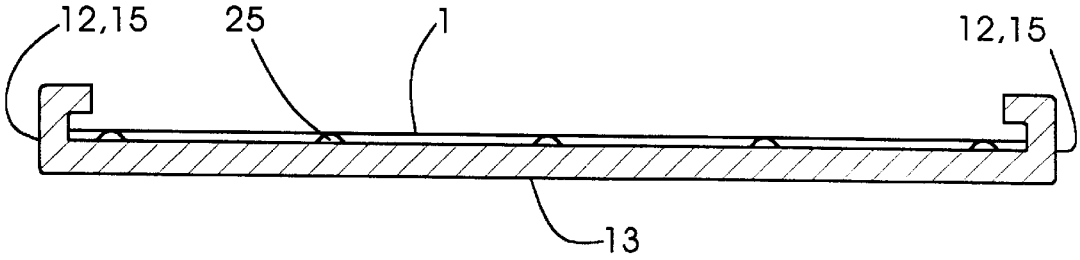
Fig.2a
Fig.2
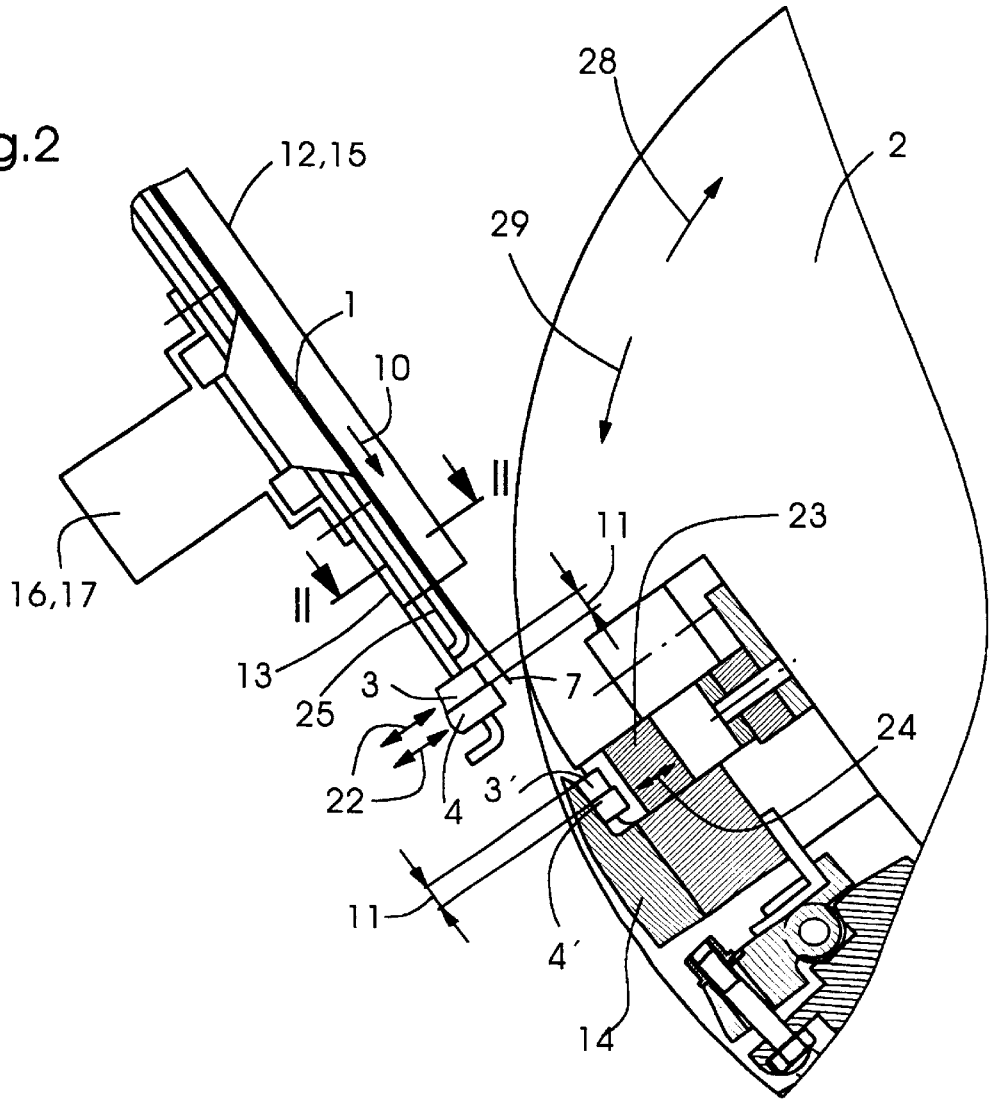

METHOD AND DEVICE FOR IN-REGISTER PRE-POSITIONING A PRINTING PLATE

BACKGROUND OF THE INVENTION

Field Of The Invention

The invention relates to a method for in-register pre-positioning a printing plate in a plate feeding device, the printing plate being pre-positioned by a positioning device of the plate feeding device and then being fed to the plate cylinder and clamped into a leading edge clamping device of the plate cylinder.

The invention relates, furthermore, to a device for performing the method with a plate feeding device having at least two positioning pins which, for the pre-positioning of a printing plate, engage in recesses formed in the latter and which are bringable out of engagement, and with a device for transferring the pre-positioned printing plate onto the leading edge clamping device of the plate cylinder.

Such pre-positioning of a printing plate has become known heretofore from the published German Patent Document DE 195 08 844 A1. In the plate feeding device heretofore known from this publication, it is not possible to check whether pre-positioning has taken place correctly and therefore in-register. Moreover, a transport device is provided for transferring the pre-positioned printing plate onto the leading edge clamping device of the plate cylinder, the transport device having arranged thereon suckers which grasp the pre-positioned printing plate. The transport device, driven by pneumatic cylinders, then conveys the printing plate into the leading edge clamping device of the plate cylinder. This type of transfer of the pre-positioned printing plate onto the leading edge clamping device is not only complicated and costly, but also too inaccurate to transfer the pre-positioned printing plate in-register onto the leading edge clamping device of the plate cylinder.

Both from the failure to check the pre-positioning register accuracy and the construction of the device for transferring the pre-positioned printing plate onto the leading edge clamping device of the plate cylinder, checking or controlling in-register positioning taking place only after the insertion of the printing plate into the leading edge clamping device. The disadvantage thereof, however, is that the check and correction of the register accuracy of the positioning of the printing plate then have to be performed entirely during the shutdown or stoppage of the press. A necessary setup time consequently becomes longer, thus leading to a lesser utilization of the press.

SUMMARY OF THE INVENTION

It is accordingly an object of the invention to provide a method and device for pre-positioning a printing plate in-register wherein the checking of the in-register positioning of the printing plate and any correction thereof can take place, as much as possible, while the press is running.

With the foregoing and other objects in view, there is provided in accordance with one aspect of the invention, a method for in-register pre-positioning a printing plate in a plate feeding device, wherein the printing plate is pre-positioned by a positioning device of the plate feeding device, and then fed to a plate cylinder and clamped into a leading edge clamping device of the plate cylinder, which comprises detecting the in-register pre-positioning by sensors and, if appropriate, correcting the pre-positioning, and then transferring the printing plate in-register to the leading edge clamping device of the plate cylinder.

In accordance with another mode, the method of the invention includes holding the printing plates in the position of the in-register pre-positioning, and rotating the plate cylinder backwards so that the printing plate is received in the leading edge clamping device.

In accordance with a further mode, the method of the invention includes detecting by sensors the in-register reception of the printing plate into the leading edge clamping device and, if appropriate, performing a recorrection.

In accordance with another aspect of the invention, there is provided a device for in-register pre-positioning a printing plate in a plate feeding device, having at least two pre-positioning pins which, for pre-positioning a printing plate, are disengageably engageable in recesses formed in the printing plate, and a device for transferring the pre-positioned printing plate to a leading edge clamping device of the plate cylinder, comprising sensors on the plate feeding device for detecting the in-register pre-positioning of the printing plate, the device for transferring the printing plate being constructed so that the in-register pre-positioning is maintained.

In accordance with a further feature of the invention, the device for transferring the printing plate has a holder disposed in the plate feeding device for grasping the pre-positioned printing plate, the pre-positioning pins having drives by which the pins are disengageable, the plate feeding device being constructed and positionable so that, when the pre-positioning pins are moved away, the prepositioned and held printing plate is insertable into the leading edge clamping device by a backwards rotation of the plate cylinder.

In accordance with an added feature of the invention, the holder is at least one lifting sucker.

In accordance with an additional feature of the invention, the in-register pre-positioning device includes guides disposed on the plate feeding device.

In accordance with yet another feature of the invention, the guides are lateral U-shaped embracing portions.

In accordance with yet a further feature of the invention, the leading edge clamping device also has at least one positioner and at least one sensor for detecting the in-register positioning.

In accordance with yet an added feature of the invention, a recess and at least one of a pre-positioning pin and a positioning pin on one side of the printing plate leading edge have noninterchangeable engagement positions in relation to at least one of a further pre-positioning pin and a positioning pin on the other side of the printing plate leading edge which is opposite to the one side with respect to a center line of the printing plate leading edge.

In accordance with yet an additional feature of the invention, the sensors are electric contacts for closing a circuit when at least one of the prepositioning pins and the positioning pins engage exactly in the recesses.

In accordance with another feature of the invention, at least one of the pre-positioning pins and the positioning pins is formed as an electric contact in only a subregion on a front side thereof.

In accordance with a first alternative feature of the invention, the sensors are formed as capacitive sensors.

In accordance with a second alternative feature of the invention, the sensors are optical sensors.

In accordance with a third alternative feature of the invention, the sensors are ultrasonic sensors.

In accordance with a fourth alternative feature of the invention, the sensors are inductively acting sensors.

In accordance with a fifth alternative feature of the invention, the sensors are microswitches.

In accordance with a concomitant feature of the invention, the in-register pre-positioning device includes resilient guide elements disposed in the region of the pre-positioning pins for forcing the printing plate into an operating range of the pre-positioning pins.

Regarding the method, the object is achieved in that the in-register pre-positioning is detected by sensors and, if appropriate, is corrected, and in-register transfer to the leading edge clamping device of the plate cylinder then takes place.

Regarding the in-register pre-positioning device, the object is achieved, according to the invention, in that the plate feeding device has sensors for detecting the in-register pre-positioning of the printing plate, and the device for transferring the printing plate is constructed so that the in-register pre-positioning is maintained.

By virtue of the invention, the printing plate is made ready in register, so that, as a rule, after the transfer of the pre-positioned printing plate to the plate cylinder, only fine corrections still have to be made during the shutdown or stoppage of the press, these corrections in any case presupposing a proof print. Correction of the positioning of the printing plate after the insertion thereof into the leading edge clamping device is usually no longer necessary before a proof print is made, because, by virtue of the invention, these corrections are transposed into the printing plate feeding device. Such corrections may thereby be made as early as when the printing press is still printing the previous order. In this way, the press shutdown time is shortened and, consequently, the efficiency of the press is increased.

In a method development which is particularly advantageous in terms of the register accuracy of the transfer, the printing plates are held in the position of the in-register pre-positioning, and reception thereof in the leading edge clamping device takes place as a result of a backwards rotation of the plate cylinder.

In an expedient construction, in-register reception into the leading edge clamping device of the plate cylinder is also detected by sensors, so that the correctness of the transfer can be checked and, if appropriate, an additional correction made. A further check is thus performed, and it is possible that incorrect settings and malfunctions can be noticed and corrected even before a proof print is made.

There are various technical possibilities for constructing the device for the in-register transfer of the pre-positioned printing plate to the leading edge clamping device of the plate cylinder. For example, it is possible for this device to be constructed so that it is provided with appropriate measures for ensuring absolute parallelism of the position of the printing plate leading edge before and after transport. However, this is complicated and costly. In order to achieve an in-register transfer, therefore, it is proposed, as a simple and optimally functioning development, that the device for transferring the printing plate have a holder which is disposed in the plate feeding device and which grasps the pre-positioned printing plate, that the prepositioning pins be equipped with drives, by which they can be brought out of engagement, and that the plate feeding device be constructed and positionable so that, when the pre-positioning pins are moved away, the pre-positioned and held printing plate can be inserted into the leading edge clamping device by a backwards rotation of the plate cylinder. It is additionally proposed that the holder be at least one lifting sucker.

In order that the printing plates can be positioned exactly, if possible as early as while being introduced into the plate feeding device, it is proposed that guides be arranged on the plate feeding device. Such guides may be formed as lateral U-shaped embracing portions. By guides of this type, it is possible for the printing plate, even while being introduced into the plate feeding device, to be positioned exactly, in such a way that a correction is often no longer necessary.

In one development, the leading edge clamping device also has positioning pins and sensors for detecting in-register positioning. As already mentioned with regard to the method, faults which occur can be detected immediately and corrected promptly.

In a construction for preventing a laterally transposed insertion of a printing plate, it is proposed that a pre-positioning pin and/or positioning pin and a recess on one side of the printing plate leading edge have noninterchangeable engagement positions in relation to a further prepositioning pin and/or positioning pin on that side of the printing plate leading edge which is opposite thereto with respect to the center line. These noninterchangeable engagement positions can be formed in various ways, and reference is made to the description of the figures with regard to construction or design possibilities.

There are various possible types of sensors for detecting the exact engagement of the pre-positioning pins and/or positioning pins into the recesses of the printing plates:

One possibility, which is simple to implement, is for the sensors to be electric contacts which close a circuit, for example, via the printing plate, when the pre-positioning pins and/or positioning pins engage exactly in the recesses. It is proposed, as an advantageous construction, that the pre-positioning pins and/or positioning pins be formed as electric contacts in only a subregion on a front side of the pins. This ensures that electric contact occurs only when the positioning pins are received entirely in the recesses.

However, capacitively or inductively acting sensors may also be used as sensors. If plastic printing plates are used, optical sensors, ultrasonic sensors or microswitches may also be provided.

If printing plates which have already been used once for printing are used again, there is the problem that they have a curve or bend formed therein and therefore may slide past the pre-positioning pins. To solve this problem, it is proposed that resilient guide elements be arranged in the region of the pre-positioning pins, the guide elements forcing the printing plate into the operating or effective range of the pre-positioning pins.

Other features which are considered as characteristic for the invention are set forth in the appended claims.

Although the invention is illustrated and described herein as embodied in a method and device for in-register prepositioning a printing plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 2 is a fragmentary side elevational view, partly in section, of an exemplary embodiment of a plate feeding device in order to explain the functioning of the subject of the invention, FIG. 2*a* is a cross-sectional view of FIG. 2 taken along the line II—II through the plate feeding device;

DESCRIPTION OF THE PREFERRED EMBODIMENTS

Figure 1:
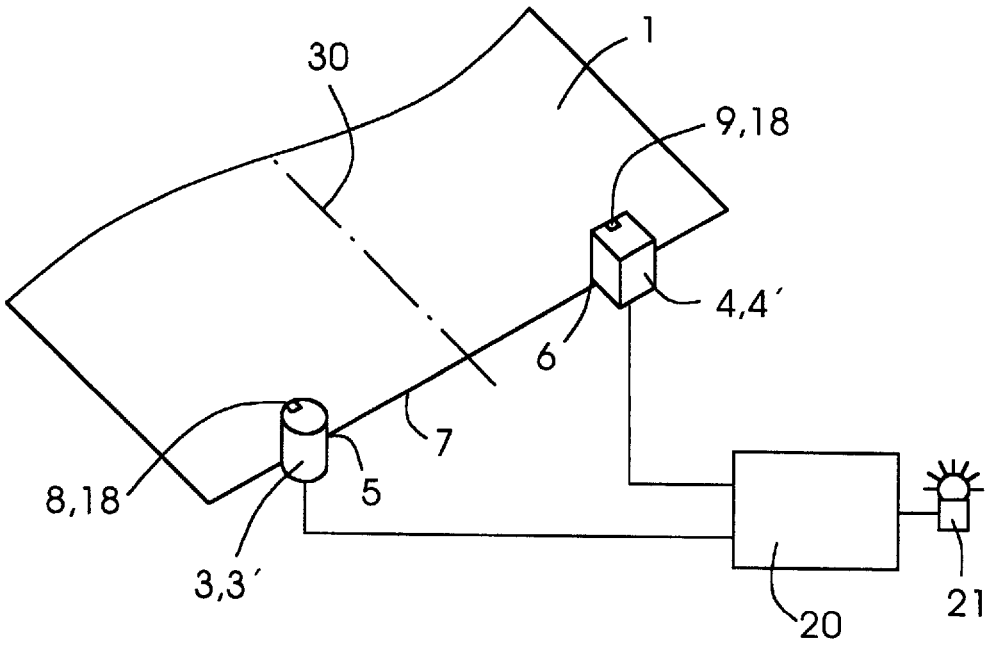
FIG. 1 is a diagrammatic and schematic view of a first embodiment of a sensor arrangement according to the invention.

Referring now to the drawings and, first, particularly to FIG. 1 thereof, there is shown therein a possible arrangement of sensors 8 and 9 for detecting in-register pre-positioning of a printing plate 1.

Arranged on pre-positioning pins 3 and 4 or on positioning pins 3' and 4' are electric contacts 18 which, when the pre-positioning pins 3, 4 or the positioning pins 3', 4' engage in recesses 5, 6 of a printing plate 1, they come into contact with the latter and consequently close a circuit. The signal can be transmitted to an evaluation device 20, and an indicator device 21 indicates that the printing plate 1 is positioned in-register. The signal may, of course, also be transmitted to the printing press control which, after receiving it, clears the way for further method steps.

Figure 1A:
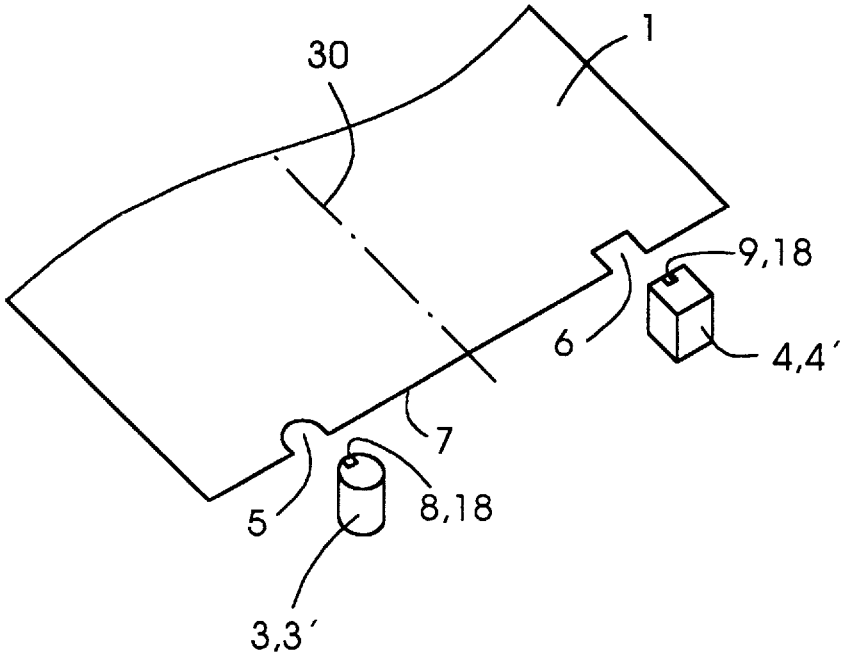
FIG. 1*a* is a view like that of FIG. 1 of a further embodiment.

FIG. 1*a* shows configuration of sensors 8 and 9 for detecting in-register pre-positioning of a printing plate 1, in which the pre-positioning pins 3, 4 or positioning pins 3', 4' have not yet engaged in the recesses 5, 6 of the printing plate 1.

Both in FIG. 1 and in FIG. 1*a*, shapes selected for the pre-positioning pins 3, 4 or the positioning pins 3', 4' and for the recesses 5, 6 of the printing plate 1 are those which make contacting possible only in the case of the laterally correct insertion of the printing plate 1. These different shapes are expediently assigned in each case to one side of the printing plate leading edge 7, as seen from a center line 30.

FIG. 2 shows an exemplary embodiment of a plate feeding device 13 and its co-operation with the leading edge clamping device 14 of the plate cylinder 2. Arranged at the lower end of the plate feeding device 13 are pre-positioning pins 3, 4 which are moveable in the direction of the double-headed arrows 22. They can thereby be put into an engagement position, in which, as illustrated in FIG. 1, they engage in recesses 5 and 6 formed in the printing plate 1. These pre-positioning pins 3, 4 have sensors 8 and 9 which either are constructed as shown in FIGS. 1 and 1*a*, or have another of the aforementioned possible constructions.

When a printing plate 1 is introduced from above into the plate feeding device 13, it is guided by guides 12 and pushed or slid in the direction of the arrow 10, until the pre-positioning pins 3 and 4 engage in the respective recesses 5 and 6. When the sensors 8 and 9 indicate that the pre-positioning pins 3 and 4 engage exactly in the respective recesses 5 and 6, holders 16 can be activated. In the illustrated exemplary embodiment, the holders 16 are formed as lifting suckers 17 which are arranged preferably so as to be spaced in the vertical direction. When the lifting suckers 17 have grasped the printing plate 1, the pre-positioning pins 3 and 4 can be displaced in the direction of the double-headed arrows 22 into the position shown. At the same time, the printing plate 1, held by the lifting suckers 17, maintains its pre-positioning exactly. By virtue of the arrangement of the pre-positioning pins 3 and 4 at the lower end of the plate feeding device 13 and due to the construction and positioning of the plate feeding device 13, it is possible for the printing plate leading edge 7 to be received by the leading edge clamping device 14 of the plate cylinder 2. In this case, the positioning pins 3' and 4' of the leading edge clamping device 14 can then engage in the recesses 5, 6 formed in the printing plate leading edge 7. For this purpose, the plate cylinder 2 rotates backwards, from the position shown, in the direction of the arrow 28, until the printing plate 1 is inserted into the leading edge clamping device 14. In the leading edge clamping device 14, the positioning pins 3' and 4' may likewise be equipped with sensors 8, 9 for checking the positioning once again.

After the printing plate leading edge 7 has been inserted into the leading edge clamping device 14, the movable clamping jaw 23 closes and, at the same time, clamps the printing plate leading edge 7. The double-headed arrow 24 indicates the clamping and releasing movement of the moveable clamping jaw 23. After the printing plate 1 has been clamped, the plate cylinder 2 executes a forward rotation in the direction of the arrow 29 and, at the same time, receives the printing plate 1 which can finally also be inserted with its trailing edge into a trailing edge clamping device, and clamped.

In this exemplary embodiment, the pre-positioning pins 3 and 4 and the positioning pins 3' and 4' have an offset 11 of their engagement positions, with the result that a laterally transposed insertion is no longer possible. In a construction of this type, the leading edge clamping device 14 must be equipped with guides 12 which prevent the printing plate 1 from assuming an oblique or inclined position, together with making contact, despite a laterally transposed insertion.

FIG. 2*a* is a cross-sectional view of FIG. 2 taken along the section line II—II through the plate feeding device 13. This illustrates how the guides 12 are formed as U-shaped embracing portions 15. Assurance is thereby provided, when the printing plate 1 is inserted, that it is guided so that the recesses 5 and 6 engage around the respective pre-positioning pins 3 and 4 and, as a rule, exact pre-positioning is achieved immediately. When the sensors 8 and 9 signal such exact pre-positioning, the holders 16, formed as lifting suckers 17, are activated. FIG. 2*a* shows, furthermore, how the plate feeding device 13 is equipped with sliding devices 25. These may be rollers or beads coated with sliding medium.

Figure 3:
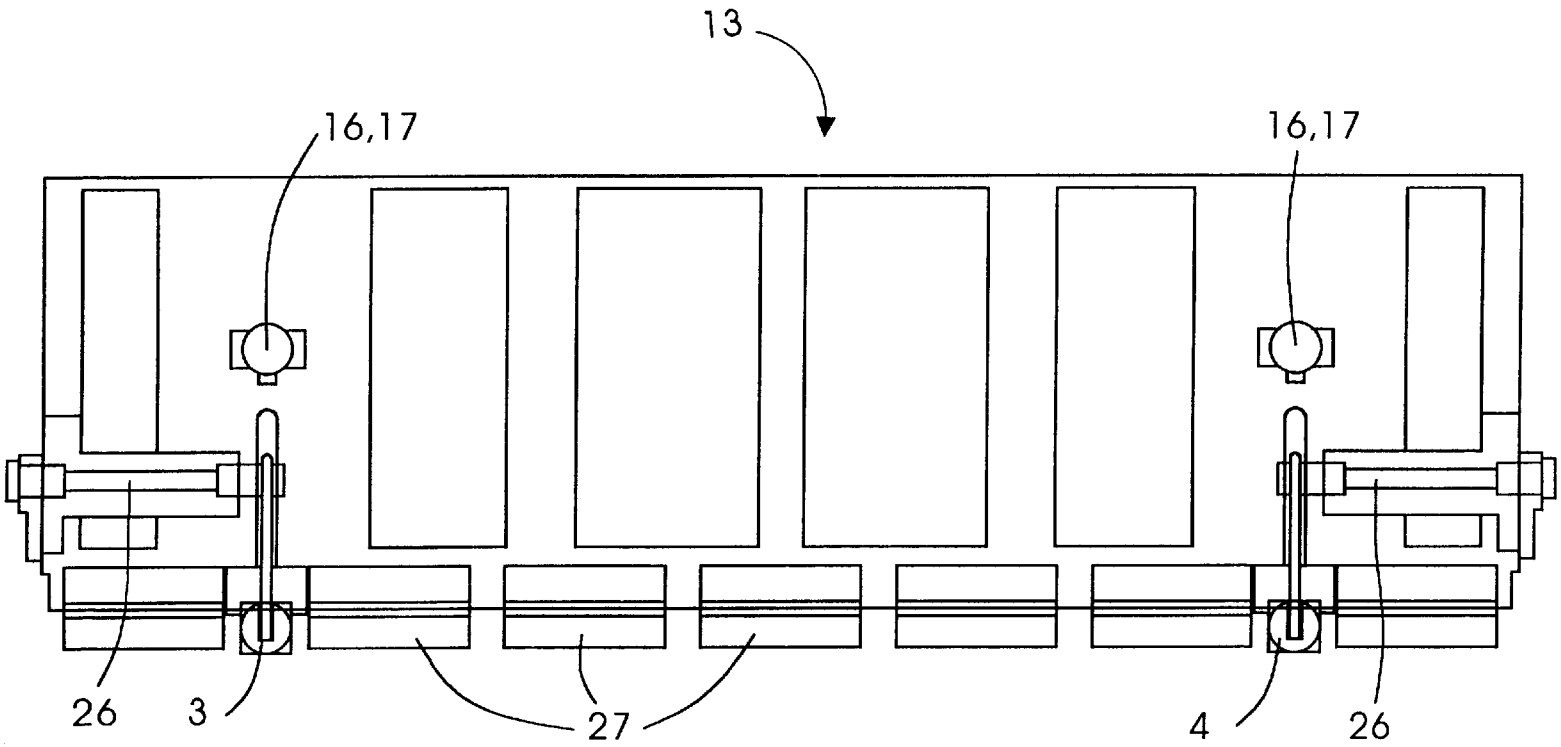
FIG. 3 is a fragmentary plan view of an exemplary embodiment of a plate feeding device showing a subregion thereof.

FIG. 3 shows a subregion of an exemplary embodiment of a plate feeding device 13. It illustrates the pre-positioning pins 3 and 4 which are arranged at the lower end that can be displaced by the drive 26, as was shown by the double-headed arrows 22 in FIG. 2. Arranged above the pre-positioning pins 3, 4 are holders 16 formed as lifting suckers 17, their function having been described hereinabove. Rollers 27 at the end of the plate feeding device 13 ensure undamaged guidance of the printing plates 1 in the end region of the plate feeding device 13 during transfer of the printing plates 1 onto the plate cylinder 2.

Figure 4:
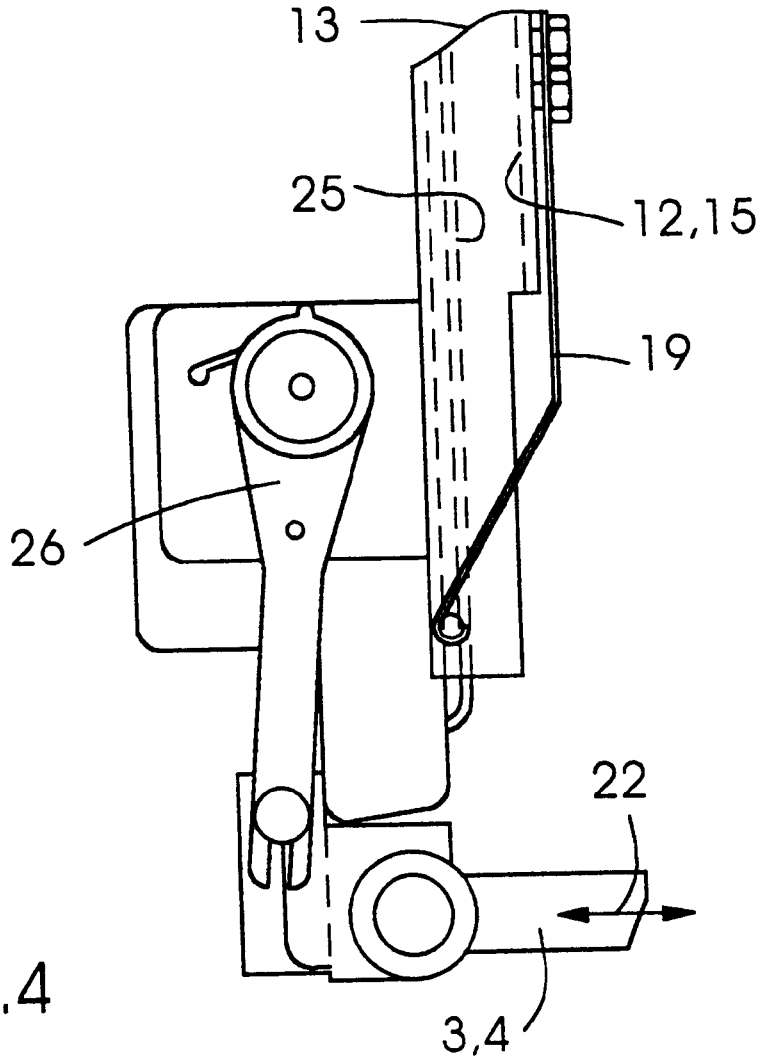
FIG. 4 is a fragmentary side elevational view of a plate feeding device showing a detail thereof.

FIG. 4 shows a detail of the plate feeding device 13. In addition to the elements already described, a resilient guide element 19 is arranged in the region of the pre-positioning pins 3 and 4, the guide element ensuring that even printing plates 1 which have already been used once for printing and which have a curve or bend formed therein are guided so that the pre-positioning pins 3 and 4 engage in the recesses 5 and 6 of the printing plate. Such printing plates 1, too, can thereby be handled without any problems.

We claim:

1. A device for in-register pre-positioning a printing plate in a plate feeding device, having at least two pre-positioning pins which, for pre-positioning a printing plate, are disengageably engageable in recesses formed in the printing plate, and a device for transferring the pre-positioned printing plate to a leading edge clamping device of the plate cylinder, comprising sensors on the plate feeding device for detecting the in-register pre-positioning of the printing plate, the device for transferring the printing plate being constructed so that the in-register pre-positioning is maintained.

2. The in-register pre-positioning device according to claim 1, wherein the device for transferring the printing plate has a holder disposed in the plate feeding device for grasping the pre-positioned printing plate, the pre-positioning pins having drives by which the pins are disengageable, the plate feeding device being constructed and positionable so that, when the pre-positioning pins are moved away, the prepositioned and held printing plate is insertable into the leading edge clamping device by a backwards rotation of the plate cylinder.

3. The in-register pre-positioning device according to claim 2, wherein said holder is at least one lifting sucker.

4. The in-register pre-positioning device according to claim 1, including guides disposed on the plate feeding device.

5. The in-register pre-positioning device according to claim 4, wherein said guides are lateral U-shaped embracing portions.

6. The in-register pre-positioning device according to claim 1, wherein the leading edge clamping device also has at least one positioner and at least one sensor for detecting the in-register positioning.

7. The in-register pre-positioning device according to claim 4, wherein a recess on one side of the printing plate leading edge defines a noninterchangeable engagement position of at least one of a pre-positioning pin and a positioning pin in relation to a recess formed in the other side of the printing plate leading edge which is opposite to the one side with respect to a center line of the printing plate leading edge and defining an engagement position of at least one of a further pre-positioning pin and a positioning pin.

8. The in-register pre-positioning device according to claim 1, wherein said sensors are electric contacts for closing a circuit when at least one of the prepositioning pins and the positioning pins engage exactly in the recesses.

9. The in-register pre-positioning device according to claim 8, wherein at least one of the pre-positioning pins and the positioning pins is formed as an electric contact in only a subregion on a front side thereof.

10. The in-register pre-positioning device according to claim 1, including resilient guide elements disposed in the region of the pre-positioning pins for forcing the printing plate into an operating range of the pre-positioning pins.

* * * * *